US005888129A

United States Patent [19]

Neff

[11] Patent Number: 5,888,129

[45] Date of Patent: Mar. 30, 1999

[54] GRINDING WHEEL

[76] Inventor: Charles E. Neff, 2140 Del Monte, Houston, Tex. 77019

[21] Appl. No.: 857,022

[22] Filed: May 15, 1997

Related U.S. Application Data

[60] Provisional application No. 60/016,646 May 15, 1996.

[51] Int. Cl.[6] ..... B24D 5/14

[52] U.S. Cl. ..... 451/541; 451/544

[58] Field of Search ..... 451/49, 541, 544, 451/461, 58, 42

[56] References Cited

U.S. PATENT DOCUMENTS

| | | | |
|---|---|---|---|
| 3,537,216 | 11/1970 | Borgh | 451/58 |
| 3,802,130 | 4/1974 | Lindenbeck | 451/544 |
| 5,496,208 | 3/1996 | Neff | 451/541 |

*Primary Examiner*—Robert A. Rose
*Attorney, Agent, or Firm*—Leydig, Voit & Mayer, Ltd.

[57] ABSTRACT

A grinding wheel having a portion of its leading radially extending wall dome-shaped and having a sector thereof coated with a coarse-textured abrasive coating that performs rapid material removal from a workpiece. Radially outward of the coarse sector, the remainder of the radially extending wall and the outer (circumferential) portion are coated with a fine-textured abrasive coating for providing a smooth finish. The working surface of the coarse-textured abrasive coating extends to an outermost radial dimension that is smaller than the radial dimension of the working surface of the finer-textured coating. The differential in dimensions defines the incremental material removal that is accomplished by the fine-textured abrasive coating. The change of textures occurs at a transition line along the radially extending surface of the grinding wheel and therefore localizes stresses in a region of the workpiece that is located radially outward of the portion of the workpiece that will constitute the final surface finish. The coarse-textured and fine-textured abrasive coating are preferably in orderly patterns shaped and oriented to optimize the finish of the workpiece, the speed of processing and the ease of manufacture when used in conjunction with the stepless dual-textured construction.

13 Claims, 7 Drawing Sheets

| DEGREES | PROFILE |
|---|---|
| 30<br>90 |  |
| 0.0<br>60 |  |
| ± 10<br>50<br>70 |  |

GRINDING WHEEL

FIELD OF THE INVENTION

This is a complete specification based upon Provisional Application Number 60/016,646, filed May 15, 1996 and relies on that application for priority purposes.

This invention relates to grinding wheels and, more particularly, to grinding wheels including abrasive elements that have been oriented in a predetermined pattern on portions of a specially shaped grinding wheel that simultaneously achieves aggressive material removal and a smooth surface finish.

DESCRIPTION OF THE RELATED ART

Feed rollers are used in manufacturing operations to advance continuous-formed web materials such as paper through a series of sequential operations. A feed roller is typically a cylindrically shaped structure constructed from a compliant material such as natural rubber, an elastomer, a foam etc. Through repeated use, the surface of a roller becomes worn necessitating regrinding and/or replacement. The surface of a roller may be renewed using an outer diameter, or OD, grinder to remove the worn portion. In an OD grinding operation, a cylindrical workpiece (e.g., the roller) is placed between centers and rotated while a grinding wheel is brought into contact with the surface of the workpiece, then plunged to a desired depth of cut after which the wheel traverses the length of the workpiece. In this manner the worn portion of the roller is removed leaving the outer surface smooth. A similar procedure may be used to prepare the surface of a roller during its initial manufacture.

When a great deal of material must be removed from a roller, it is usually desirable to quickly remove this material to achieve a rough, but oversize, workpiece dimension. Such an operation is referred to as hogging. Hogging typically leaves a rough surface finish that must be cleaned-up by a light cut performed by a finish-grind operation. These two distinctly different grinding operations may be performed using two grinding wheels and two machines.

Alternatively, hogging and finishing may be accomplished simultaneously using a "dual-textured, stepped wheel." A dual-textured/stepped wheel has a coarse-textured abrasive coating located adjacent the leading edge of the grinding wheel and a fine-textured abrasive coating located adjacent the trailing edge. The leading/trailing designation comes from reference to the direction in which the grinding wheel traverses the workpiece during a grinding operation with the coarse-coating leading. On a dual-textured/stepped wheel the working surface of the coarse-textured coating is dome-shaped and extends radially outward to a preselected radial dimension and the working surface of the fine-textured coating has a slightly greater radial dimension. The difference in these dimensions establishes the incremental amount of material removed by the fine-textured coating. A known dual-textured/stepped wheel provides a radial transition intermediate the two axially-extending, circumferential portions of the grinding wheel that provide two abrasive sections, the coarse-texture and then the fine-texture, respectively.

Although, compared to two machines, a dual-textured/stepped wheel provides an improvement in operational efficiency, this improvement is accomplished at the cost of a degradation in surface-finish quality. Stresses in the material of the workpiece and consequent distortion result from contact with the grinding wheel during a grinding operation.

These stresses occur principally at the radial transition between the textures. High stresses extend well into the structure of the workpiece radially outward from an imaginary cylinder defined by the desired ultimate finished surface of the workpiece. Because the ultimate finished surface of the workpiece is being ground while it is in this stressed and therefore distorted condition, surface finish irregularities manifest themselves when the stresses of grinding are removed and the workpiece returns to an undistorted condition. The result is surface-finish imperfections.

In addition, a dual-textured/stepped wheel also suffers from an inherent design weakness in that the intersection between coarse and fine-textured abrasive coatings occurs at the transition that is located intermediate the axially extending circumferential portions of the grinding wheel thereby requiring the fine-textured abrasive elements immediately adjacent the transition to perform essentially all of the material removal of the entire fine-textured abrasive coated section. This heavy work-load causes the leading portion of the fine coating to wear-out first. In practice when this portion of the fine-textured abrasive coating has worn out, the coarse-textured abrasive coating of a conventional dual-textured/stepped wheel typically has substantial life remaining which is therefore wasted. In a utopian world a dual-textured grinding wheel would feature coarse and fine textures that wear out at precisely the same time over their entire surfaces.

Finally, typical grinding wheels feature a multitude of abrasive elements that are arranged in a random pattern. An ideal surface-finish smoothness is achieved by using a grinding wheel that incorporates abrasive elements of uniform character that are arranged in a pattern that maximizes the number of individual paths carved in the workpiece for each revolution. If abrasive elements are arranged in a random pattern a substantial probability exists that sequentially occurring abrasive elements located on a grinding wheel will be circumferentially aligned and thus travel an identical path through the workpiece, failing to achieve the maximizing objective.

In addition, it has been found that a random orientation of abrasive elements complicates and consequentially impedes the flow of debris away from the point at which the debris is formed; whereas, a chip flow path which may be established by using a predetermined pattern of abrasive elements will ease elimination of chips from the locations at which they are generated. This reduces any risk that the chips will be smeared back into the workpiece surface or load the abrasive coating of the grinding wheel.

OBJECTS OF THE INVENTION

The objects of the present invention include a grinding wheel that eliminates the differential stresses produced by a dual-textured/stepped wheel, an arrangement of the abrasive elements of an abrasive in a pattern to maximize the effectiveness of a grinding operation, to optimize the smoothness of both a rough-grind and a fine-grind coating to optimize debris removal to realize improved operation from the new structures and combinations of the new structures provided.

Other objects, advantages and features of the present invention will become apparent upon reading the following detailed description of preferred embodiments and the appended claims and upon reference to the accompanying drawings.

SUMMARY OF THE PRESENT INVENTION

The present invention includes a grinding wheel having a portion of its leading radially-extending dome-shaped surface coated with a coarse-textured abrasive coating that performs rapid material removal from a workpiece and having the remainder of the radial portion plus the outer (circumferential) portion coated with a fine-textured abrasive providing a smooth surface-finishing section. The working surface of the coarse-textured coating extends radially to a circle having a radius significantly smaller than the periphery having a working surface with the finer-textured coating. The differential in dimension defines the incremental material removal that is accomplished by the fine-textured coating. The transition between the textures occurs at a point along the radially extending surface of the grinding wheel without a radial step and therefore localizes the transition stresses in a region of the workpiece that is subjected to a further fine texture grinding operation providing a continuum with the coarse texture portion to produce the final surface finish and size.

In this manner the stepless grinding wheel of the present invention may traverse along the surface of a workpiece, typically a spinning rubber roll, to provide simultaneous roughing and finishing operations all in one operation and with precision. This reduces the number of grinding wheels and the grinding operations required. The configuration also provides longer tool life and improved debris removal.

BRIEF DESCRIPTION OF THE DRAWINGS

Further features and advantages of the present invention will be apparent to those skilled in the art to which the invention relates from the following detailed description of the invention made with reference to the accompanying drawings in which.

Figure 1:
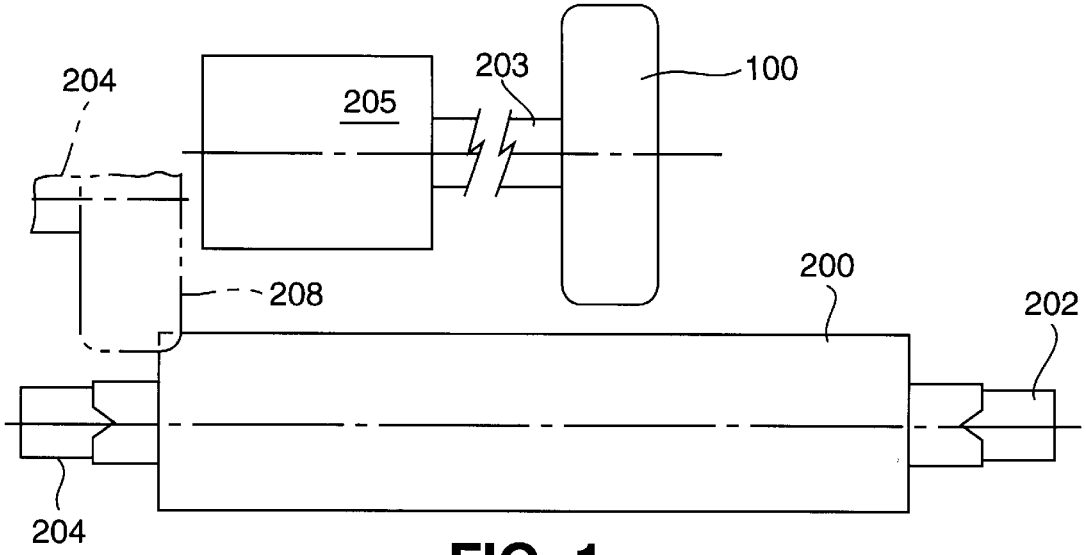
FIG. 1 is a plan view of the OD grinding machine.

The surfaces of rollers in papermaking and other web feeding apparatus are often faced with an elastomeric material that becomes worn. Those surfaces may be renewed using an OD grinder to remove the worn portion. In an OD grinding operation as shown in FIG. 1, a cylindrical workpiece 200 (e.g., the roller) is placed between centers 202, 204 and rotated. A grinding wheel 201 is mounted for rotation on a shaft 203 driven by a motive means such as electric motor 205. The motor, shaft and wheel are mounted on a carriage for rotation about an axis parallel to the axis of the workpiece 200. The carriage is mounted for axial movement in the direction indicated by arrow 106. The wheel 100 is shown transversely displaced from the workpiece 200 but it should be clear that the wheel would be initially positioned generally as shown by the broken lines 208. In operation the wheel moves to the right as shown in FIG. 1 to perform the resurfacing operation. In this manner the worn portion of roller 200 is removed leaving the outer surface smooth. A similar procedure may be used to prepare the surface of a roller during its manufacture.

Figure 2:
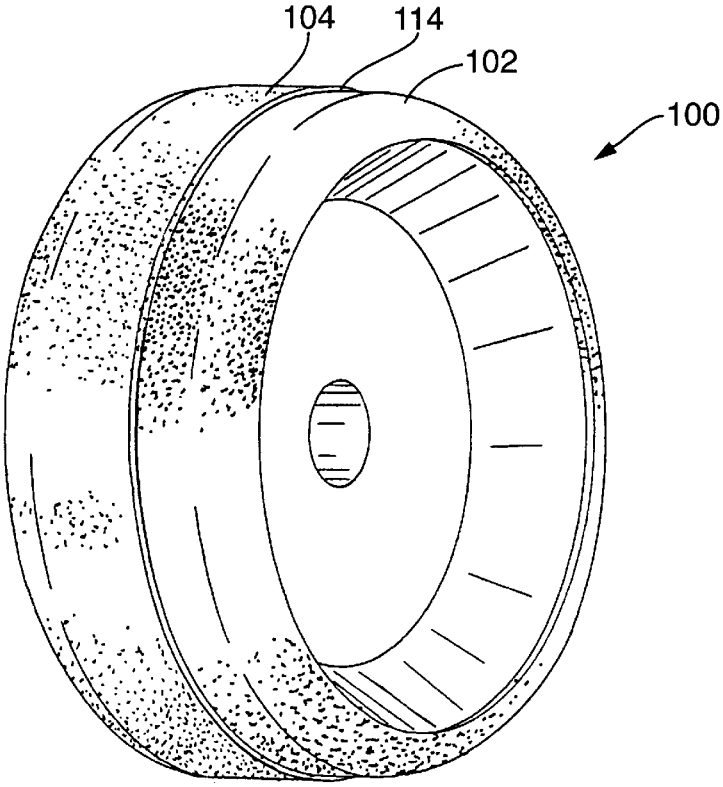
FIG. 2 (PRIOR ART)
FIG. 2 is a perspective view of a prior art, dual-textured/stepped wheel.
Figure 3:
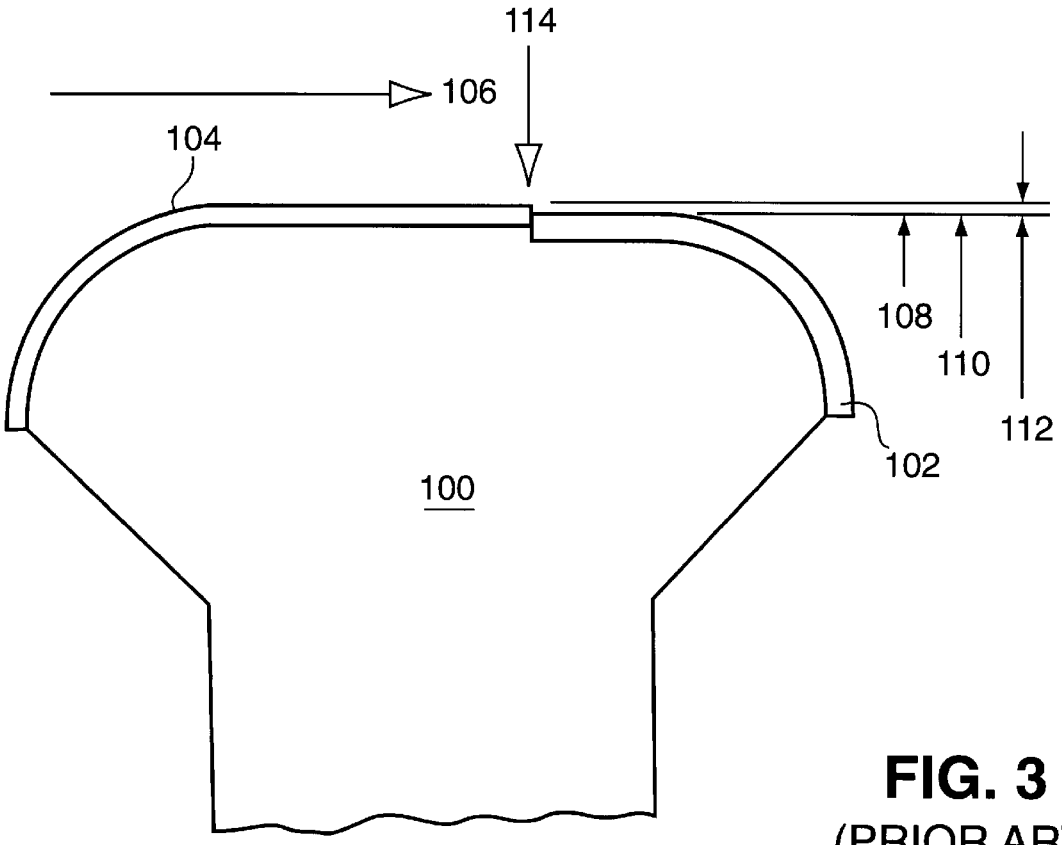
FIG. 3 (PRIOR ART)
FIG. 3 is a cross section of a fragment of the dual-textured/stepped wheel of FIG. 1.

AS explained above, rough-cutting (hogging) and fine-cutting (finishing) may be accomplished simultaneously using a "dual-textured" or "stepped wheel." A prior art dual-textured/stepped wheel 100 is illustrated in perspective in FIG. 2 and in cross-section in FIG. 3. As shown in those figures, a coarse-textured abrasive coating 102 located on the leading edge and dome-like, radially-extending face of grinding wheel 100 precedes a fine-textured peripheral abrasive coating 104 located on the trailing edge. The leading/trailing designation comes from reference to the direction 106 in which the grinding wheel traverses the workpiece during a grinding operation. On a prior art dual-textured/stepped wheel the working surface of the coarse-textured coating 102 extends to a radial dimension 108 and the working surface of the fine-textured coating 104 extends to a radial dimension 110. The difference in these dimensions; difference space 112, is equivalent to the incremental material removed by fine-textured coating 104. A prior art dual-textured/stepped wheel provides a transition 114 intermediate the two axially-extending, circumferential portions of the grinding wheel.

Figure 4:
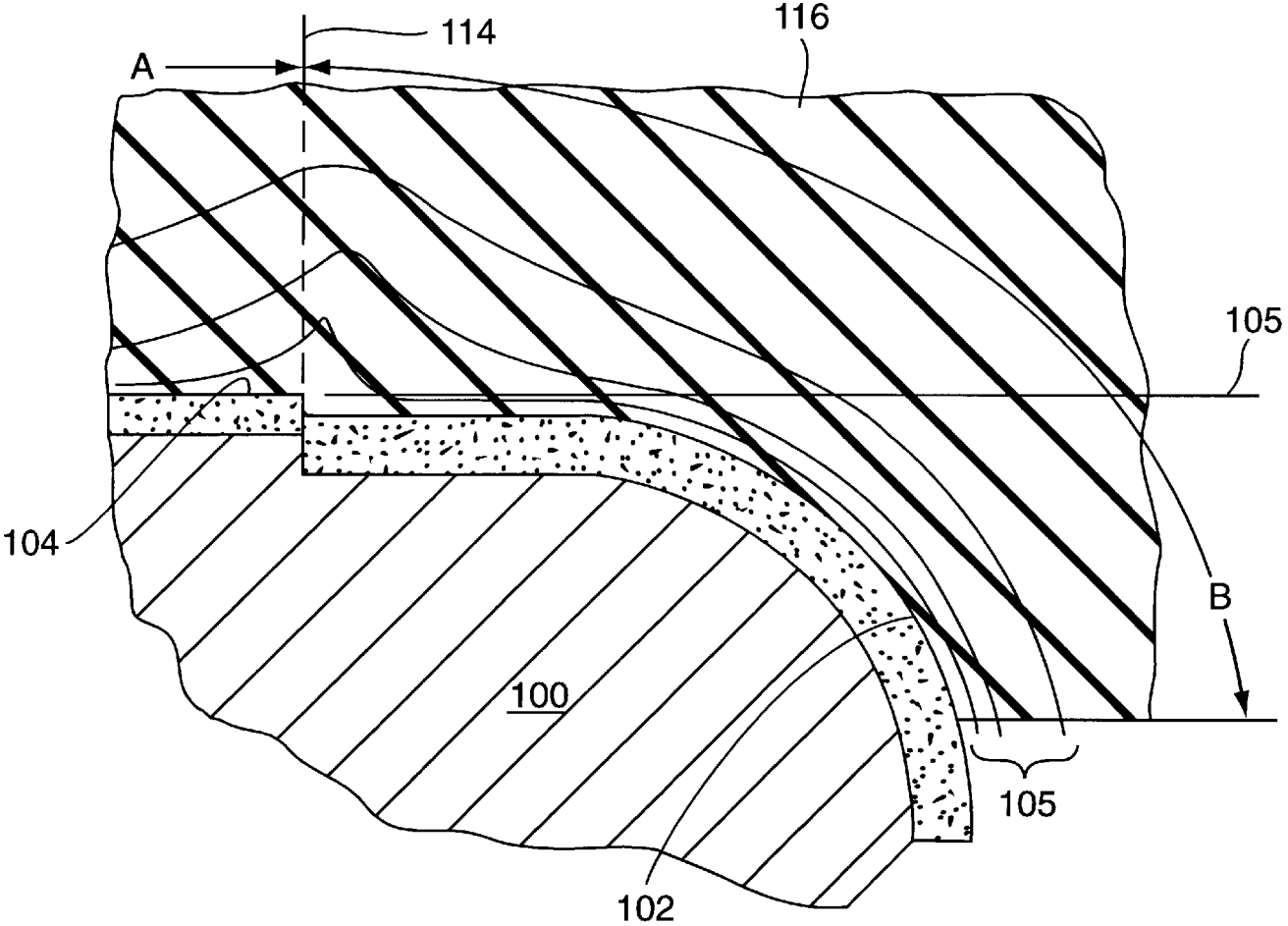
FIG. 4 (PRIOR ART)
FIG. 4 is a cross section of a dual-textured/stepped wheel engaged with a workpiece illustrating isometric stress distributions.

FIG. 4 illustrates isometric lines 105 of equal stress in the material of workpiece 116 that result from contact with the grinding wheel 100 during a grinding operation. These isometric lines reveal peak stresses at step 114 that extend radially into the mass of workpiece 116. It is believed that the ultimate finished surface of workpiece 116 is being ground while it is in this stressed and therefore distorted condition, surface finish irregularities manifest themselves when the stresses of grinding are removed and workpiece 116 returns to an undistorted condition.

DETAILED DESCRIPTION OF THE PREFERRED EMBODIMENTS

Figure 5:
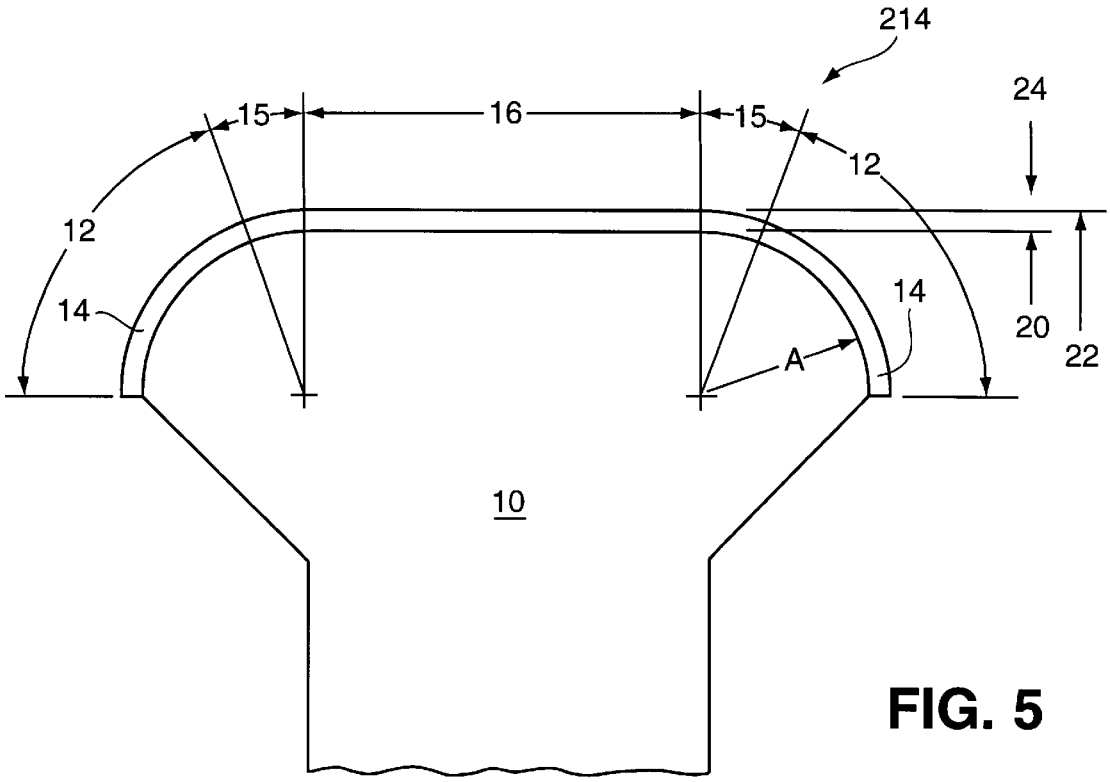
FIG. 5 a cross section of a fragment of dual-textured stepless wheel of the present invention.
Figure 6:
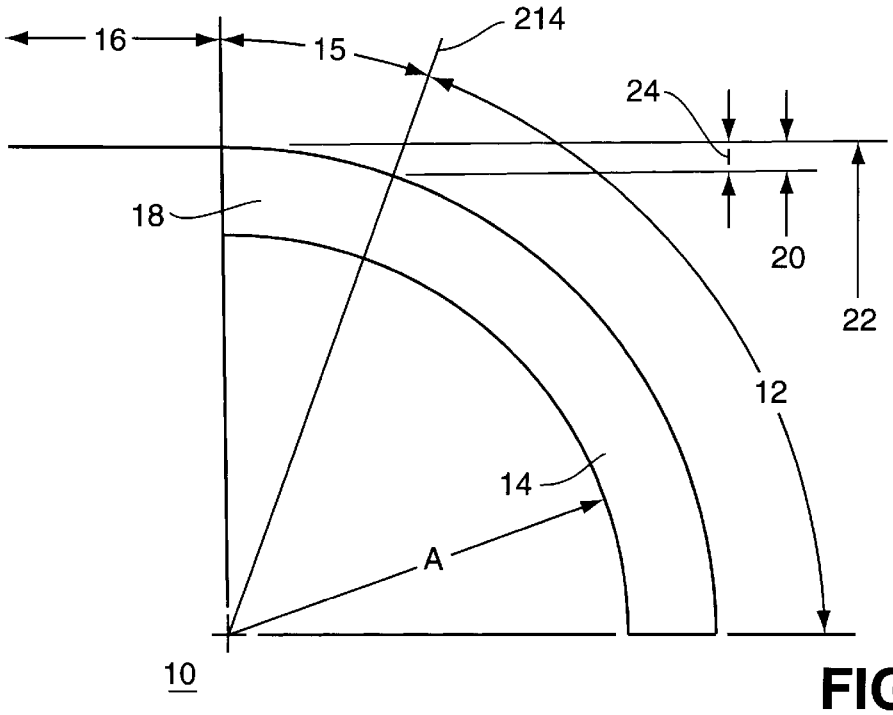
FIG. 6 is an enlarged view of the cross section showing the transition area of a wheel constructed according to the present invention.
Figure 9:
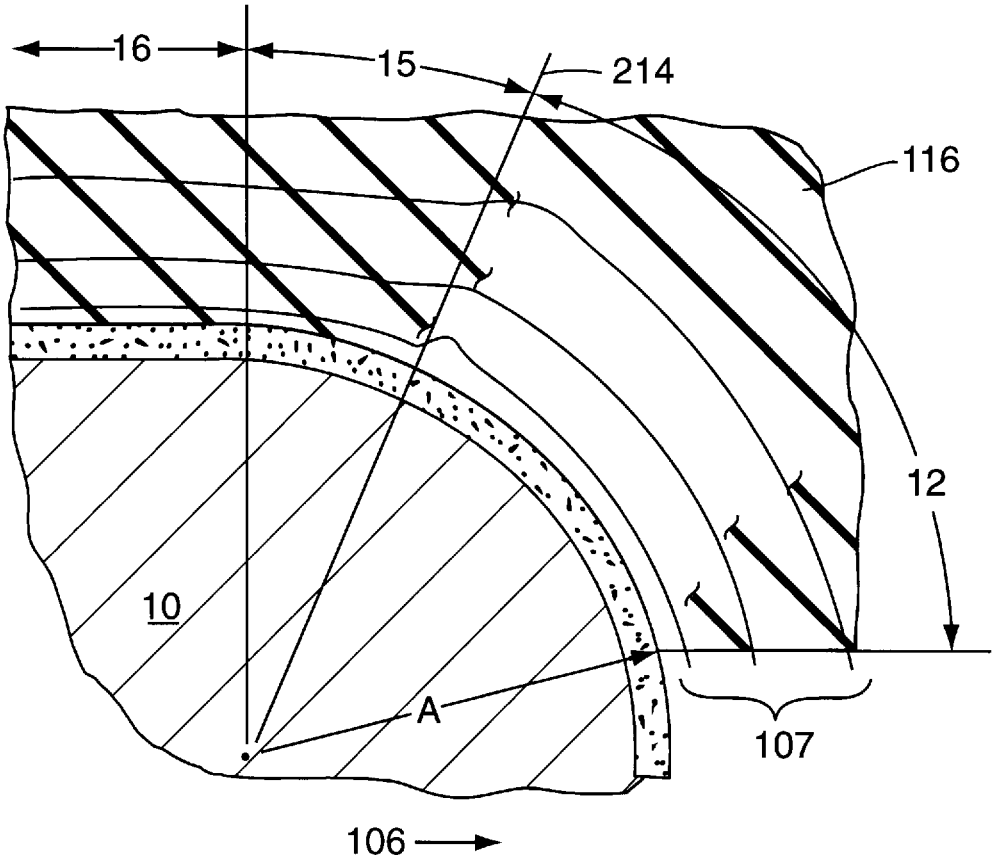
FIG. 9 is a cross section of a dual-textured/stepless wheel of the present invention engaged with a workpiece and illustrating an isometric pattern of stresses that may occur.

The preferred embodiment of the present invention as illustrated in FIGS. 5 and 9 has a dual-textured/stepless abrasive surface 10 constructed on a steel wheel 10 having a cross section as shown in FIG. 5. The wheel 10 has a right circular cylindrical control portion at its periphery with dome-like edge portion of radius A. The surface comprises a sector portion 12 of radius A and sector angle less than 90° coated with a coarse-textured abrasive coating 14. A sector portion 15 of radius A located between sector 12 and the outer (circumferential) portion 16 is coated with a fine-textured abrasive coating 18. In use, grinding wheel 10 engages workpiece 116 as shown in FIG. 9 and is advanced in direction 106 making a cut from workpiece 116 generally as shown in FIG. 9. The final surface produced by this operation is a right circular cylinder equal to the original workpiece diameter less the depth of the cut as shown. The working surface of coarse-textured abrasive coating 14 extending to an outermost radial dimension 20 from the tool center (not shown) removes a majority of the depth of cut. The working surface of the fine-textured abrasive coating 18 extends along the sector 15 to an outermost radial dimension 22 from the tool center. That dimension is slightly greater than dimension 20 by the difference 24 and therefore removes a small amount of material providing a clean-up and finishing operation. FIG. 9 includes several isometric lines of equal stress 106 in workpiece 116 that occur during a grinding operation using grinding wheel 10 constructed according to the teachings of the present invention. The lines of stress in the roller 166 in the finishing sector 15 and cylindrical surface 16 are more uniform having smaller peaks that those observed in FIG. 4. This uniformity results from relocation of the abrasive transition to this location on dome-shaped radial surface and elimination of the step 114. The surface of workpiece 116 that is being ground to provide the ultimate finish is not distorted by the stresses imposed by a step such as step 114.

In this manner grinding wheel 10 may be traversed along the surface of workpiece 116 to provide simultaneous roughing and finishing operations all in one step. This reduces the number of grinding wheels and grinding operations required. It also enables the use of improved patterns and textures that combine with the smooth transition on the radial wall providing additional quality enhancement.

Figure 7:
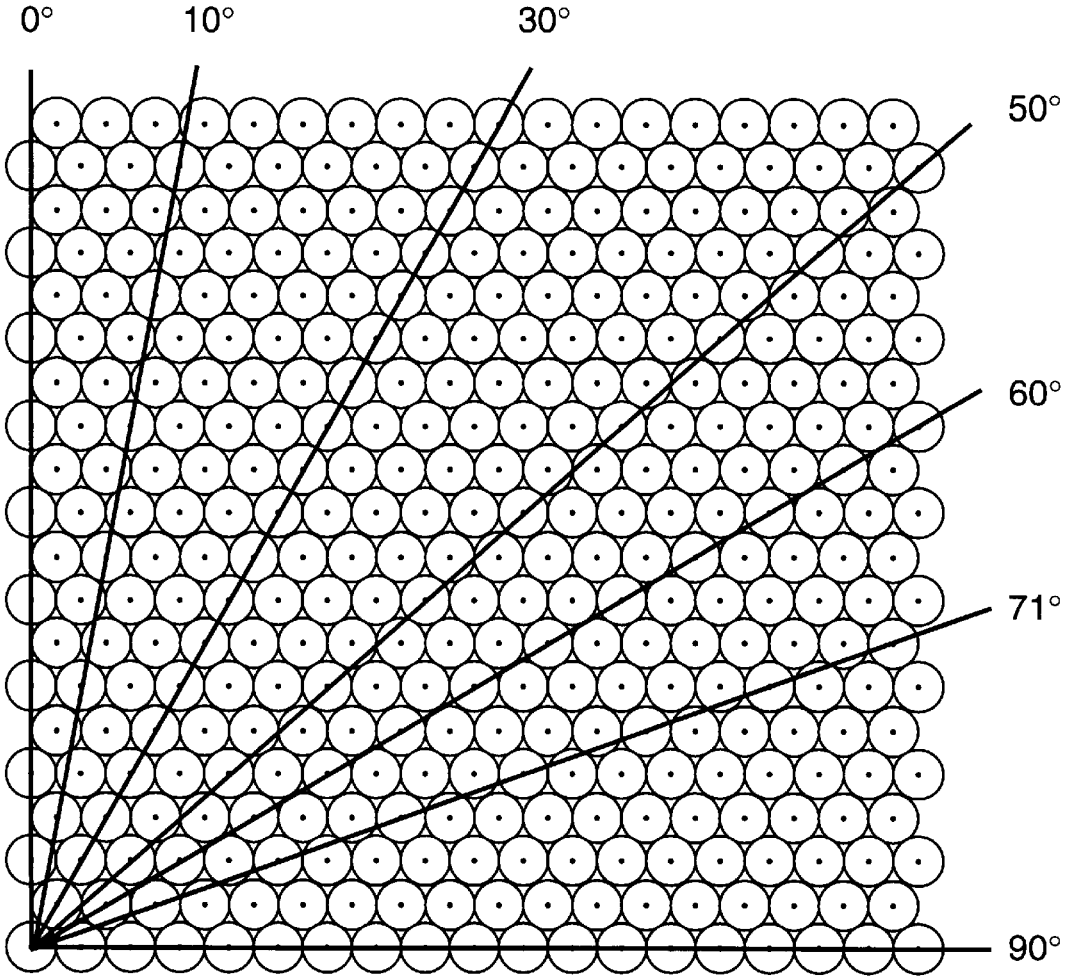
FIG. 7 is a plan view of an offset-centered pattern of abrasive elements.
Figure 8:
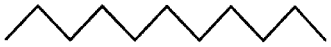
FIG. 8 is a side view taken along selected axes of FIG. 7 illustrating some of the available offset-centered patterns of abrasive elements.
Figure 8:
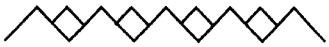
Figure 8:
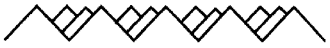

The texture of an abrasive coating is a function of the size, spacing and orientation of abrasive particles used to produce the abrasive coating. Conventional abrasive coatings have texture grades defined by the size of the particle; for example, 50 grit is one grit size used as a texture gradation for crushed carbide coatings brazed to steel wheels; sandpaper textures are graded by the number of particles per unit area. In such products the grit distribution is generally random. Controlling the texture of an abrasive coating by means of the orientation of a pattern of elements is described in U.S. Pat. Nos. 5,213,590, 5,181,939, 5,336,279 and 5,496,208 to NEFF. NEFF teaches that a pattern of abrasive elements arranged in sequential rows having offset centers, as shown in FIG. 7, can accomplish a variety of textures, aggressive actions and other grinding objectives and parameters depending on the orientation of the pattern axes and the direction of relative motion with respect to a workpiece. These axes may be observed in side profile revealed in FIG. 8 by moving to various positions 0, 10, 30, 50, 60, 70 and 90 around the pattern. For example, if the 30 degree-axis is aligned with the axis of relative motion, maximum material removal will be realized and maximum surface roughness will be experienced. However, if the 10 degree-axis is aligned with the axis of relative motion, maximum surface smoothness will be achieved but with minimum material removal from the workpiece surface. Thus in some applications of the instant invention the same pattern of abrasive elements and abrasive elements of the same size and pattern density can be used for a plurality of cutting aggression and pattern finish. Thus a single abrasive coating can be used to achieved the full range of grinding objectives. On the other hand, the size of the abrasive elements that make up the pattern may also be varied for an even wider range of finish and aggression.

The grinding performance of a pattern of abrasive elements is affected by the orientation of the pattern with respect to the workpiece as well as the dimensions of and between the individual abrasive elements of the pattern. For example, a pattern having abrasive elements that are spaced at 0.040 inches will produce a smoother finish than a pattern in which the abrasive elements are spaced at 0.090 inches. The size of each element also affects the finish and aggression. Orienting a pattern of abrasive particles that fill their respective spaces at 0.090 inch intervals with the 30 degree pattern axis aligned with the axis of motion relative to a workpiece produces an ideal abrasive coating for hogging; whereas, a pattern of abrasive particles that fill their respective spaces at 0.040 inch intervals with the 10 degree pattern axis aligned with the axis of motion relative to a workpiece produces an ideal abrasive coating for finishing.

Figure 11:
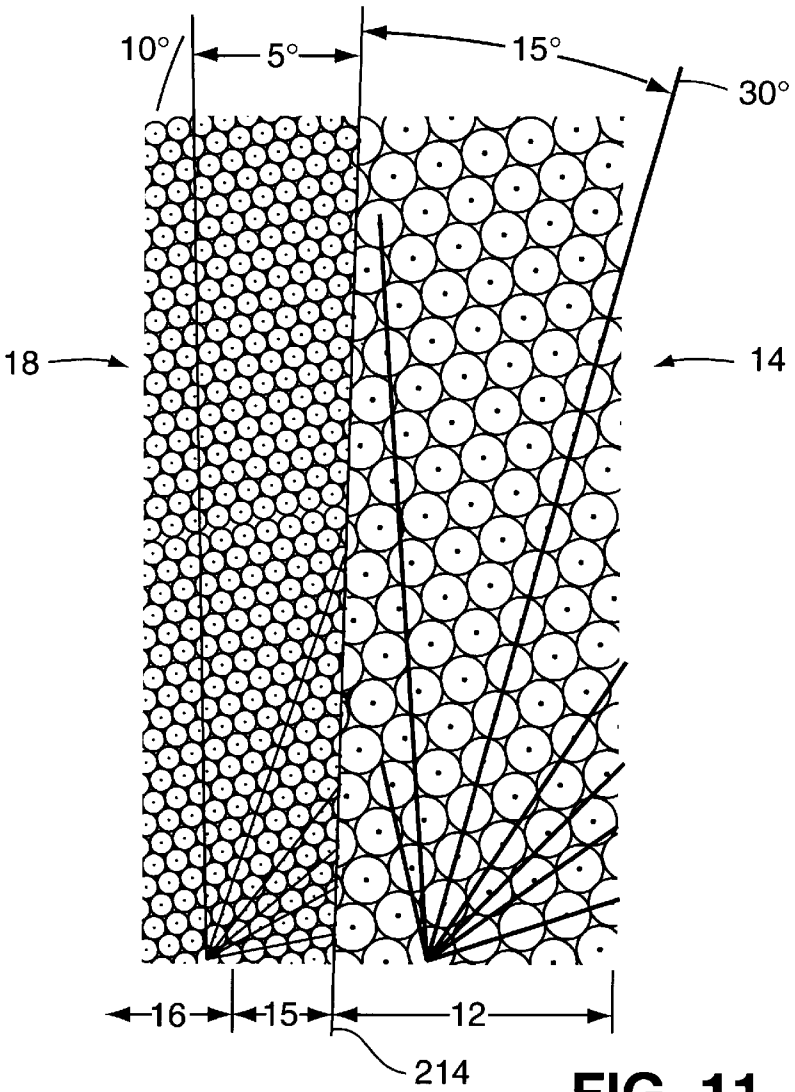
FIG. 11 is a plan view of the coatings of one embodiment of the present invention laid flat and canted according to the teachings of the present invention.
Figure 10:
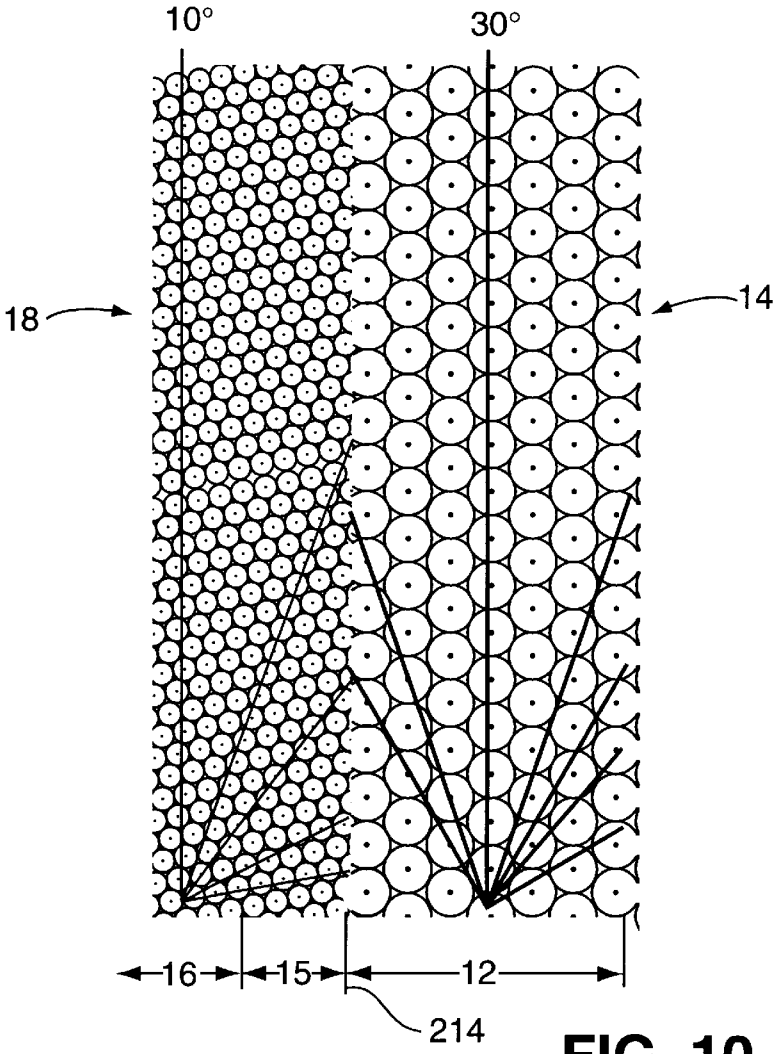
FIG. 10 is a plan view of the coarse and fine textured abrasive coatings around the transition and laid flat without canting and as oriented on one grinding wheel constructed in accordance with the present invention.

The preferred embodiment of the present invention features a grinding wheel that utilizes a pattern of abrasive particles having a 30 degree-axis pattern covering sector 12 of the radially extending portion and a 10 degree-axis pattern covering sector 15 and cylindrical surface 16. These patterns are illustrated in FIG. 10 laid-out side-by-side on the respective sides of the transition line 214. The 30 degree-axis pattern covering sector 12 presents an aggressive abrasive coating for performing significant material removal; hogging. Using this pattern oriented in this manner reduces the current drawn by the motor driving the grinding wheel and provides for open cutting action with ease of chip elimination. The size of chip generated in a hogging operation using an abrasive pattern comprising of elements that are oriented as shown in FIG. 10 can exceed the capacity of an existing dust collection system. Therefore the pattern may be altered slightly by varying the orientation of the 30 degree-axis pattern plus or minus 15 degrees. FIG. 11 illustrates a wheel having sector 12 covered with 30 degree-axis patterns that are canted anywhere from 0 to 15 degrees. It is contemplated by the invention that sector 12 in the cross section of FIG. 9 may comprise a plurality of sectors around the circumference of a grinding wheel. For example, the circumference could comprise six 60° sectors covered with sequentially recurring patterns that may be canted in the same direction, alternately canted or any combination of cant/no cant to accomplish the objectives of finish and aggression according to the present invention. Canting the pattern on sector 12 of the dome-like surface is desirable because it not only helps control the size of the chip being generated but it reduces the roughness of the surface finish left by the hogging operation thereby reducing the work the fine-textured portions 15 and 16 must perform. Canting that exceeds plus or minus 15 degrees is undesirable because heating of the workpiece is increased and life of the coarse-textured coating is reduced. At the present time, 5 degree cant of the 30 degree-axis pattern produces the best compromise between size of chips, workpiece heating, surface finish quality, electric current draw and grinding wheel life.

The preferred embodiment of the present invention as shown in FIG. 5 features a 10 degree-axis wrapped around portions 15 and 16 of grinding wheel 10. The 10 degree-axis pattern presents a relatively fine-textured abrasive coating to the workpiece and the pattern removes sufficient material (a dimension of material equal to the difference in radial dimension 22 minus 20; or difference dimension 24) to clean-up any surface-finish roughness remaining after the hogging operation has been completed. The smoothness of the surface-finish produced by the 10 degree-axis pattern disposed on portions 15 and 16 of grinding wheel 10 can be improved by applying the coating in circumferentially extending segments of limited length that are alternatively canted such that the 10 degree-axis is canted anywhere from 0 to 15 degrees (preferably 5 degrees) from alignment with the direction of relative motion between the pattern and the workpiece as shown in FIG. 11. This technique produces a side-wise sweeping action as canted pattern segments of abrasive particles sequentially engage the workpiece.

The reference made herein to 10 and 30 degree-axis patterns is not limited to precisely that pattern orientation but may include replications of these axes that occur as one moves around to various positions about the pattern. For example, a 30 degree-axis pattern is repeated at 90, 150, etc; whereas, a 10 degree-axis pattern is repeated at 50, 70, etc. In addition, this invention is not limited to patterns of abrasive elements that have been arranged in sequential rows that are offset from one another by one-half an interelement dimension; referred to herein as, offset centered, but may include abrasive elements arranged in sequentially occurring rows that form columns of sequentially occurring rows of elements that are offset by a dimension smaller than one-half the interelement dimension or any other repeating pattern of elements. Also, the discrete angular change that occurs at the juncture of sequentially occurring alternating canted patterns covering portions 15 and 16 of wheel 10 may be blended into a smooth transition best described as a sinusoidal-type or serpentine pattern.

In the preferred embodiment of the present invention the transition from sector 12 to sector 15 occurs at an angle of 15 to 20 degrees from the intersection of cylinder 15 and sector 16 at an angular location that results in a radial differential as shown in FIG. 5. The transition can occur between the working surfaces of sector 15 and the corresponding surface of cylinder 16 that is at least 0.010 and at most 0.035 inch. One skilled in the art will appreciate that the dome-like surface of sectors 12 and 15 can be completely smooth at the transition 214 by judicious selection of element sizes and patterns or can have a taper or gradual transition surface that is continuous. In either event, it is preferred that the transition 214 contains no step. The advantage of moving the transition 214 into the dome-like radially extending surface is best observed in FIG. 9. FIG. 9 includes isometric lines of equal stress 107 in the workpiece. The transition point 214 produces some stresses in the material of the workpiece. However, the stresses are relatively uniform especially near the cylindrical finishing work surface 16. In this manner, portions 15 and 16 of grinding wheel 10 that engage the workpiece 116 do not distort the workpiece and when relaxed the workpiece will exhibit the same smooth-surface finish produced during grinding. In addition, the incremental annulus of workpiece 116 that is removed during the finish operation is removed primarily by the sector 15 of the fine-texture coating; thus spreading this work over the axial dimension thereof. By spreading this work over a greater axial dimension, the grinding occurs at a lower temperature and wear is reduced.

The apparatus of the present invention and many of the intended advantages will be understood from the foregoing description and various changes may be made in form, construction and arrangement of parts without departing from the spirit and scope of the invention or sacrificing its material advantages; the embodiments herein described being merely preferred or exemplary.

What is claimed is:

1. An abrasive tool comprising a tool base having a supporting surface and an abrasive surface layer on said supporting surface, said layer being circular and rotatable about a central axis thereof for removing material from a workpiece surface by contact therewith and by relative movement thereof along a working path parallel to and spaced from said axis, said abrasive tool comprising opposed, radially extending faces and an outer circumferential surface extending axially therebetween, one of said faces having a first circumferential portion adjacent said circumferential surface and extending radially and axially therefrom, and a second circumferential portion extending radially and axially from said first portion, wherein the abrasive surface layer on said circumferential surface and said first portion comprises discrete abrasive elements arranged in an orderly pattern, the abrasive surface layer of said circumferential surface and said first portion being relatively fine and the abrasive surface of said second portion being relatively coarse.

2. The abrasive tool of claim 1 wherein said first portion is circular in a plane including said axis.

3. The abrasive tool of claim 1 wherein said second portion is circular in a plane including said axis.

4. The abrasive tool of claim 1 wherein said first and second portions are circular in a plane including said axis and define a continuous surface.

5. The abrasive tool of claim 1 wherein said abrasive surface layers comprise discrete abrasive elements arranged in an orderly pattern.

6. The abrasive tool of claim 5 wherein said pattern defines passageways for debris which extend diagonally to said axis.

7. The abrasive tool of claim 1 wherein there are smooth transitions in the abrasive surface layer between said circumferential portion, said first portion and said second portion.

8. The abrasive tool of claim 1 wherein the transition between said first portion and said second portion is radially displaced inwardly from said circumferential surface at least 0.015 inch.

9. The abrasive tool of claim 1 wherein the transition between said first portion and said second portion is between 0.015 and 0.030 inch from said circumferential surface.

10. The abrasive tool of claim 5 wherein the transition between said first portion and sad second portion is radially displaced inwardly from said circumstantial surface a distance at least about equal to the height of the abrasive elements of the second portion.

11. The abrasive tool of claim 5 adapted for use on an elastomeric workpiece wherein said transition between said first portion and said second portion is radially displaced inwardly from said circumferential surface a distance related to the elastomeric qualities of the workpiece whereby distortion in the fine abrasive surface layer is minimized.

12. An abrasive tool comprising a tool base having a supporting surface and an abrasive surface layer on said supporting surface, said layer having an outer circular periphery, rotatable about a central axis thereof and extending axially therefrom for removing material from a workpiece surface by contact therewith and by relative movement thereof along a working path parallel to and spaced from said axis, said abrasive tool comprising opposed, radially extending faces, one of said faces having a first circumferential portion adjacent said outer circular periphery and extending radially and axially therefrom, and a second circumferential portion extending radially and axially from said first portion, wherein the abrasive surface layer on said first portion comprises discrete abrasive elements arranged in an orderly pattern, the abrasive surface layer on said first portion being relatively fine and the abrasive surface of said second portion being relatively coarse.

13. The abrasive tool of claim 12 wherein said second portion comprises discrete abrasive elements arranged in an orderly pattern.

* * * * *